United States Patent [19]

Hexel

[11] Patent Number: 5,022,551

[45] Date of Patent: Jun. 11, 1991

[54] EASY-OPEN PACKAGE WITH COVER TAB

[75] Inventor: Günter Hexel, Braunschweig, Fed. Rep. of Germany

[73] Assignee: Schmalbach-Lubeca AG, Braunschweig, Fed. Rep. of Germany

[21] Appl. No.: 463,370

[22] Filed: Jan. 11, 1990

[30] Foreign Application Priority Data

Jan. 19, 1989 [DE] Fed. Rep. of Germany ..... 3901507
Feb. 1, 1989 [DE] Fed. Rep. of Germany ..... 3902912

[51] Int. Cl.[5] ..... B65D 17/34

[52] U.S. Cl. ..... 220/270; 220/359; 220/276

[58] Field of Search ..... 220/257, 258, 269, 270, 220/276, 359

[56] References Cited

U.S. PATENT DOCUMENTS 3,580,485 5/1971 Hall .
4,346,833 8/1982 Bernhardt ..... 220/257
4,738,374 4/1988 Ingemann ..... 220/258
4,795,055 1/1989 Ingemann ..... 220/270

FOREIGN PATENT DOCUMENTS 222021 11/1961 Fed. Rep. of Germany .
2421194 11/1975 Fed. Rep. of Germany .
2071319 1/1969 France .

*Primary Examiner*—Stephen P. Garbe
*Assistant Examiner*—Nova Stucker
*Attorney, Agent, or Firm*—Herbert Dubno; Andrew Wilford

[57] ABSTRACT

A package has a vessel formed with a rim and at least one rib together forming an upwardly open compartment having a periphery and an upwardly open pocket separated by the rim from the compartment and also having a periphery. This pocket is separated at a connecting location from the compartment by the rib. A foil covering the compartment and pocket engages the rim and web all around the compartment and all around the pocket and is formed with an endless weakened tear line running along and within the periphery of the compartment except at the location, along and within the periphery of the pocket except at the location, and over the rib at the location. This foil is subdivided by the rib into a tearout tab overlying the pocket and a tearout section overlying the compartment and the web has a full thickness web extending over the rib and interconnecting the tab and section. A bond secures the foil to the vessel along and immediately outside the tear line.

5 Claims, 3 Drawing Sheets

EASY-OPEN PACKAGE WITH COVER TAB

FIELD OF THE INVENTION

The present invention relates to an easy-open package. More particularly this invention concerns such a package in which a foodstuff or the like is marketed and which is intended to be opened by hand for on-the-spot consumption.

BACKGROUND OF THE INVENTION

A standard easy-open package comprises a vessel having a flat rim and a cover foil that is bonded to the vessel at the rim. The vessel and foil together form one or more compartments that can contain respective foodstuffs, although it is within the scope of this invention for the package to contain other materials. Typically the vessel has upwardly projecting ribs that define the individual compartments and the foil is bonded to these ribs too. Both the vessel and the foil can be made of a metal, of a synthetic-resin, or of a laminate of both. A particularly advantageous system has a rigid plastic vessel to which is bonded a plastic-coated metallic foil, the bonding being done ultrasonically along bond lines running around the perimeters of the compartments. It is also of course possible to form the perimeter bond in a cold process, with an adhesive, or otherwise.

In order to remove the foil it is standard to provide it at one edge of the package with an outwardly projecting flap or tab that can be gripped by the user and pulled up away from the vessel. Such a system has the disadvantage that the manufacturer of the product must trade off a strong bond necessary to form a good hermetic seal that protects the contents and that stands up to shipping stresses against a weak bond that makes it possible to tear off the foil without using excessive force or destroying the entire package. Furthermore the outwardly projecting tearoff tab poses an inconvenience to boxing and handling the package, and often is damaged or otherwise rendered useless.

It is also known to form the cover foil with a tear line, that is a weakened strip typically formed by perforating the foil or reducing its thickness along the line, that runs around the compartment. In this case the user grips a portion of the tear-out portion that is bounded by this tear line and pulls it off the package. The problem with this system is that the foil is often poked down into the contents of the package as it is removed, making such removal messy and unsanitary. This problem can be partially solved by applying a second grip tab that is secured to the tearout section so it can be pulled up, but this extra element increases production costs too much for a throwaway item.

OBJECTS OF THE INVENTION

It is therefore an object of the present invention to provide an improved package with a removable cover foil.

Another object is the provision of such an improved package with a removable foil which overcomes the above-given disadvantages, that is which is easy to open.

A further object is to provide such a package where individual sections can be torn out of the cover foil to uncover respective compartments without in any way interfering with the seal of the adjacent compartments.

SUMMARY OF THE INVENTION

A package according to the invention has a vessel formed with a rim and at least one rib together forming an upwardly open compartment having a periphery and an upwardly open pocket separated by the rim from the compartment and also having a periphery. This pocket is separated at a connecting location from the compartment by the rib. A cover foil covering the compartment and pocket engages the rim and web all around the compartment and all around the pocket and is formed with an endless weakened tear line running along and within the periphery of the compartment except at the location, along and within the periphery of the pocket except at the location, and over the rib at the location. This foil is subdivided by the rib into a tearout tab overlying the pocket and a tearout section overlying the compartment and the web has a full thickness web extending over the rib and interconnecting the tab and section. A bond secures the foil to the vessel along and immediately outside of the tear line.

Thus with this system there is no outwardly projecting opening tab that can get damaged or create a nuisance when handling the package. In addition because the tab is unitarily formed with the rest of the foil it is not necessary to provide a separate pull tab for peeling back the tearout section of the foil, so that production costs are held down.

According to this invention a second bond secures the foil, which can also be profiled instead of being planar, at the web to the vessel along the rib. This keeps the contents of the compartment out of the tab pocket so that the tab will remain dry and clean, as will the fingers of the user, and also allows the tab to be freed, even by the producer, for later use. Furthermore the second bond at the web is substantially weaker than the first-mentioned bond so that there is no danger of tearing the tab off the foil.

The vessel and foil according to this invention are each at least partially constituted of a synthetic resin in which case the bond is a weld. The foil can be a metal/-plastic laminate with the plastic side engaging the plastic of the vessel.

Normally in accordance with this invention the foil is generally planar and the pocket has a floor that is angled upward and at an acute angle to the plane from the web. Thus when the tab is pushed down into the pocket with tearing of the line around the pocket the tab will be pushed upward by the angled floor.

The system of this invention is usable in a vessel formed with a plurality of such compartments and respective such pockets in which case the foil is formed with a respective such tear line for each compartment and the respective pocket.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
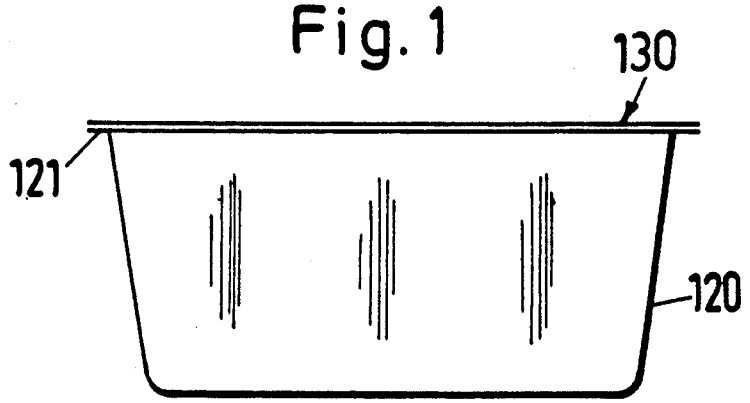
FIG. 1 is a side view of the package according to this invention.
Figure 5:
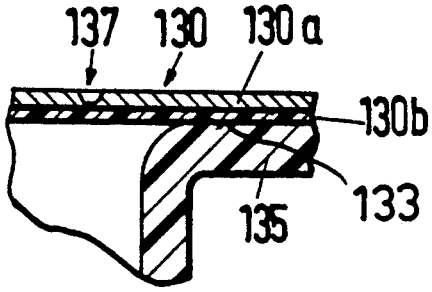
FIG. 5 is a large-scale view of the detail indicated at 5 in FIG. 4.

As seen in FIG. 1 a package is basically formed by a vessel 120 having a rim 121 lying in a plane P and a planar cover foil 130 adhered to the vessel 120 at the plane P. The vessel 1 is itself formed of a rigid synthetic resin, although it can also made of stiff metal foil or even of a foil covered with a synthetic resin, and the cover foil 1 is normally constituted as seen in FIG. 5 as a laminate of a metal layer 130*a* and a plastic layer 130*b*, the latter engaging the plastic of the vessel 120 so same can be bonded together as indicated at 133.

Figure 2:
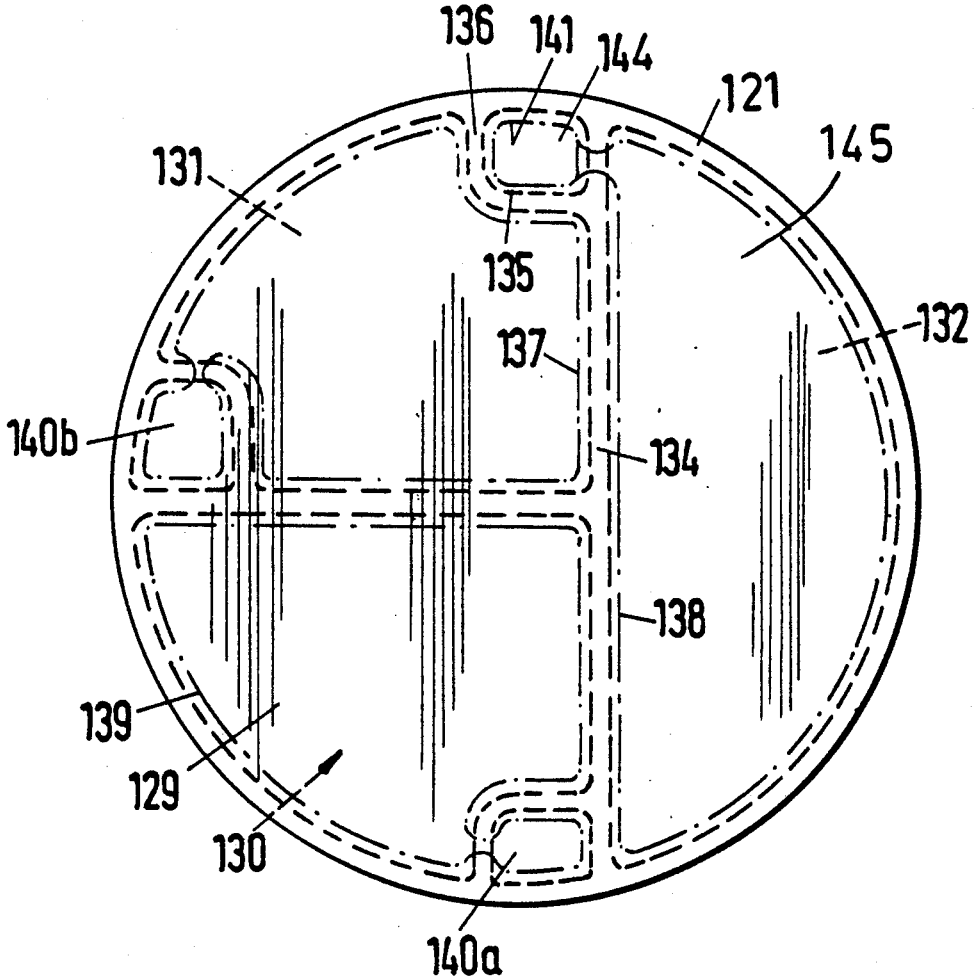
FIG. 2 is a top view of the package.

As shown in FIG. 2 the vessel 120 is subdivided by ribs 134 into three wells or compartments 129, 131 and 132, of which the first two are roughly quarter circles and the third is a semicircle, but all are of roughly the same area and volume. Furthermore the vessel 120 is formed adjacent each of these compartments with a small pocket 140, 140*a*, and 140*b* also defined by the ribs 134.

Figure 3:
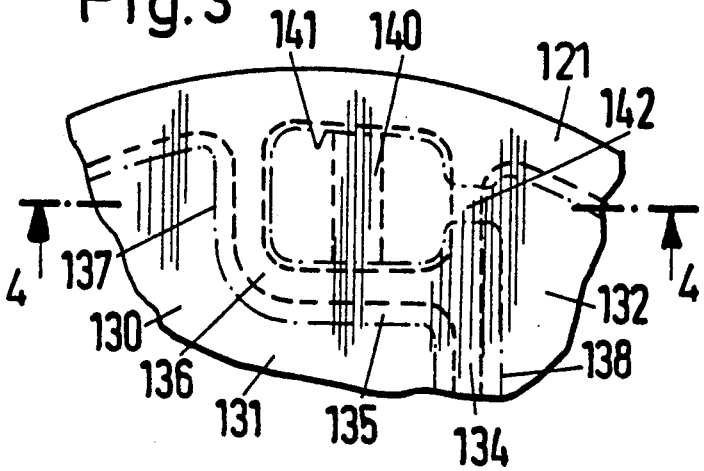
FIG. 3 ia a large-scale view of a detail of FIG. 2.
Figure 4:
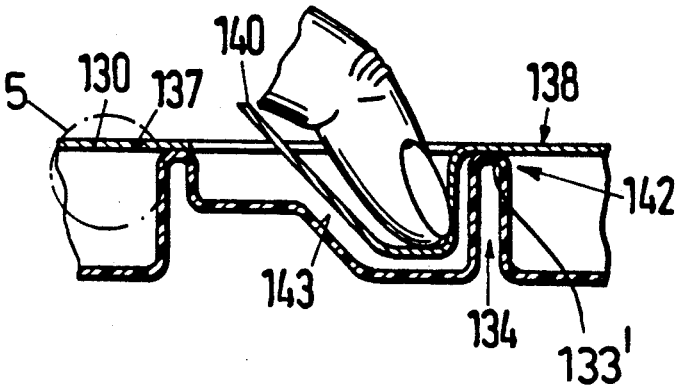
FIG. 4 is a section taken along line 4—4 of FIG. 3.

The cover foil 130 as best illustrated in FIGS. 3 and 4 for the compartment 132 and its pocket 140 is formed with a tear line 138 that extends around the perimeter of the compartment 132 and that is continued as a tear line 141 around a rib 135 forming the pocket 140. These lines 138 and 141 are actually one continuous or endless tear line with the portion 141 actually being a lobe projecting from the edge of the shape defined by the portion 138 so that a full-thickness connecting web 142 extends over the rib 134 between the compartment 132 and the pocket 140. The line 138 therefore defines a semicircular tearout portion 145 of the cover 130 that is connected at 142 to a small tab 144 delimited by the line 141.

Thus as illustrated in FIG. 4 when a finger is pressed down on the foil 130 over the pocket 140, this foil 130 will tear at the tear line 141 where it is much weaker than it is at the full-thickness web 142. The pocket 140 has an angled floor 143 that slopes up a way from the rib 134 at the web 142 so that as the tearout tab 144 is pushed down into this pocket 140 its free end will be forced up so that it can easily be grasped. The user then simply pulls the tab 144 up away from the vessel 120 so that tearing continues from the line 141 along the line 138, thereby separating the piece 145 from the foil 130 and exposing the contents of the compartment 132.

According to this invention the foil 130, which is similarly formed at the other two pockets 140*a* and 140*b*, is bonded at all regions of contact with the rim 121 and ribs 134. The bond 133' at the connecting web 142 is, however, substantially weaker than the bond 133 elsewhere, just enough to ensure that the contents of the respective compartment cannot get into the respective pocket, but not enough to make the web 142 tear when the tab 144 is lifted. This can be achieved by using a lower bonding temperature at this region when heat-sealing is employed to secure the foil 130 to the vessel 120.

Figure 6:
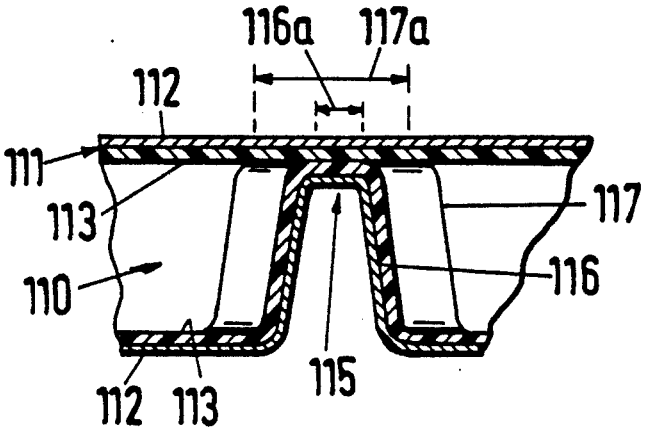
FIGS. 6 and 7 are sectional and top views of a detail of a variant on the package of this invention.
Figure 7:
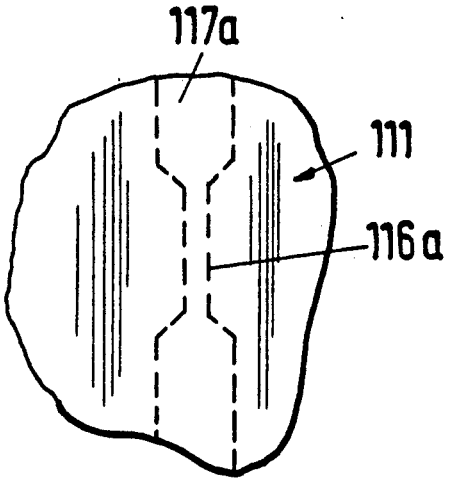

It is also possible as seen in FIGS. 6 and 7 to form a vessel 110 with a rib 115 having a relatively thick portion 117 of a thickness 117*a* and a relatively narrow portion 116 of a thickness 116*a* substantially less than the thickness 117*a*. A foil 111 comprising like the vessel 1110 a metal layer 112 and a plastics layer 113 therefore will have less area to bond to in the region 116 so that the bond here will be weaker. This region 116 is positioned at the location where the web joins the tearout tab to the tearout foil section.

I claim:

1. A package comprising:

a vessel formed with a rim and at least one rib together forming an upwardly open compartment having a periphery, and an upwardly open pocket also having a periphery and separated at a location from the compartment by the rib;

a cover foil covering the compartment and pocket, engaging the rim all around the compartment and all around the pocket, and formed with an endless weakened tear line running along and within the periphery of the compartment except at the location, and over the rib at the location, the foil being subdivided by the rib into a tearout tab overlying the pocket and a tearout section overlying the compartment, a section of the foil including a web extending over the rib and interconnecting the tab and section;

a rim bond securing the foil to the vessel along and immediately outside of the tear line; and a web bond securing the foil at the web to the vessel along the rib, the web bond being substantially weaker than the rim bond.

2. The package defined in claim 1 wherein the vessel and foil are each at least partially constituted of a synthetic resin, the bond being a weld.

3. The package defined in claim 1 wherein the foil is generally planar and the pocket has a floor that is angled upward and at an acute angle to the plane from the web, whereby when the tab is pushed down into the pocket with tearing of the line around the pocket the tab will be pushed upward by the angled floor.

4. The package defined in claim 1 wherein the vessel forms a plurality of such compartments and respective such pockets, the foil being formed with a respective such tear line for each compartment and the respective pocket.

5. The package defined in claim 1 wherein the foil is a laminate of a metal and a synthetic resin.

* * * * *